United States Patent [19]

Watts, Jr.

[11] 4,245,931

[45] Jan. 20, 1981

[54] POST ASSEMBLY AND METHOD

[76] Inventor: Ridley Watts, Jr., 34000 Cedar Rd., Gates Mills, Ohio 44040

[21] Appl. No.: 56,284

[22] Filed: Jul. 10, 1979

Related U.S. Application Data

[63] Continuation-in-part of Ser. No. 874,875, Feb. 3, 1978, Pat. No. 4,161,090.

[51] Int. Cl.[3] ..... E04H 12/00

[52] U.S. Cl. ..... 52/301; 52/309.8; 52/743; 405/255

[58] Field of Search ..... 52/301, 309.8, 514, 52/309.5, 741, 743; 220/287; 405/255

[56] References Cited

U.S. PATENT DOCUMENTS

| | | | |
|---|---|---|---|
| 1,996,401 | 4/1935 | Bowen | 52/301 |
| 2,710,996 | 6/1955 | Pittman | 52/301 |
| 3,250,050 | 5/1966 | Finger et al. | 52/301 |
| 3,319,328 | 5/1967 | Finger et al. | 52/301 X |
| 3,319,332 | 5/1967 | Finger et al. | 52/301 X |
| 3,377,808 | 4/1968 | Dougherty | 52/301 X |
| 3,448,585 | 6/1969 | Vogelsong | 405/255 X |
| 3,564,859 | 2/1971 | Goodman | 52/309.5 X |
| 4,161,090 | 7/1979 | Watts, Jr. | 52/309.8 X |

*Primary Examiner*—Carl D. Friedman

*Attorney, Agent, or Firm*—Watts, Hoffmann, Fisher & Heinke

[57] ABSTRACT

A post assembly and method of capping a post, especially useful for pilings, e.g., as used for docks and the like. A covering over a post end is comprised of an outer cover and a semi-rigid, energy-absorptive, predominantly closed-cell body of foamed synthetic resin that adheres the cover. The cover is comprised of an end plate and a surrounding skirt. The skirt is formed of an extruded strip with a longitudinal groove that receives the periphery of the plate when the strip is wrapped about the plate. Ends of the strip abut each other and are sealed. Preferably the skirt terminates in an inwardly extending inclined flange that closely encircles the pole to form a beveled lower edge to the outer cover. The cover is resistant to abrasion, impact and ultraviolet deterioration. The foamed resin fills and seals all voids in the end of the post to prevent moisture from entering and deteriorating the post, and cushions and supports the cap to inhibit cracking or puncturing of the cap from impacts in use.

9 Claims, 3 Drawing Figures

POST ASSEMBLY AND METHOD

CROSS REFERENCE TO RELATED APPLICATION

This application is a continuation-in-part of copending application Ser. No. 874,875, filed Feb. 3, 1978 now U.S. Pat. No. 4,161,090, entitled Post Assembly and Method, the disclosure of which is incorporated herein by reference.

BACKGROUND OF THE INVENTION

1. Field of the Invention

This invention relates to posts or pilings and protective end caps.

2. Prior Art

Wooden posts and pilings deteriorate in use from exposure to weather, bacteria, fungii and insects. A primary cause of this deterioration is the entry of moisture at end surfaces of the post or piling, due to the exposed end grain. Moisture is carried into the post by capillary attraction and may cause the wood to rot or may become frozen and expand to cause cracks and structural defects that shorten the useful life of the post. This deterioration requires the replacement of posts or pilings at considerable expense and is a particular problem in docks and other structures in which posts and pilings are continually subjected to water and weather. While posts and pilings are typically treated chemically, this treatment does not inhibit deterioration to the extent desired.

In the past, various covers or caps for pilings have been suggested or used. These include bituminous material such as tar paper as a cushion on the top of a post, covered with a galvanized metal cap (U.S. Pat. No. 1,637,627), an asphalt covering and a metal cap screwed to the top of the post (U.S. Pat. No. 1,707,397), a steel or copper cover with screws in a flange covering a felt pad over the end of a post, the felt pad serving as a reservoir of preservative (U.S. Pat. No. 1,996,401), a cake of wood preservative on the end of a pole, covered by an elastic cap stretched over the top (U.S. Pat. No. 3,319,328), and a metal pile shoe with wings that fold around the periphery of the post and are nailed in place (U.S. Pat. No. 3,514,959).

The present state of the art to applicant's knowledge includes the use of fiber glass cloth impregnated with a slow cure resin that is layered upon and formed to the contour of the end of a post or piling. This covering tends to pull away during the cure and leaves voids between the post or piling end and the covering cloth and when unsupported and being somewhat brittle in nature, it tends to crack or be otherwise damaged from impacts. The state of the art also includes the use of a soft metal disk across the top of a piling, hammered into shape about the end and nailed in place around a skirt portion. Typically, the formed disk is not in intimate contact throughout its extent with the surface of the post or piling and therefore tends to be easily punctured. In the case of both such covers, substantial preservative is applied prior to covering the post or piling and the application of preservative and installation of either such cover will require substantial time, reportedly on the order of 45 minutes.

In addition to the above, it is known to set poles in the ground and fill the space between the pole and surrounding ground surfaces with an expanded foam resin (U.S. Pat. Nos. 3,403,520 and 3,564,859) or to encase the tip of a pile in concrete (U.S. Pat. No. 4,006,600).

The aforementioned copending application discloses an invention that provides an inexpensive protective end cover for posts and pilings that overcomes disadvantages of the prior art and which is strong and durable as well as easily and quickly applied. The protective cover effectively prevents entrance of moisture to the end of a post or piling and has the advantage of being attractive in appearance and lends itself to bearing indicia or having color significance. A particular embodiment comprises a one-piece preformed (e.g., thermoformed) plastic cap having good impact and abrasion resistance that has a top portion for covering the end of a post and a surrounding skirt portion that extends about a peripheral portion of the post at the covered end. The cap is larger than the end of the post and is secured to and spaced slightly from the end by a foam lining that is formed in place, is semi-rigid, and serves as an adhesive to adhere the cap to the post. The foam not only seals the space between the cap and post against the entrance of moisture, but also expands and fills all voids in the end of the post and between the cap and post. This semi-rigid foam serves as a cushion and provides total support and energy absorption beneath the cap to effectively inhibit puncturing or cracking of the cap from impact.

The cap is secured to a post by mixing foam-forming chemicals and applying them between the end of a post and the cap and allowing the foam to form and expand between the two. The cap is maintained spaced slightly from the post and the expanding foam completely fills any crevices or cracks in the end of the post as well as the space between the post and cap. This assures that the end grain of the post is completely sealed from entry of moisture and provides a complete energy absorbing cushion and support for the cap.

With the thermoformed cap disclosed in the aforementioned application, an inventory of preformed caps is required for poles of various diameter, which is a disadvantage where a large variation in pole size is experienced. Also, caps of the same size, because of their substantially cylindrical skirt portions, do not readily nest and therefore require substantial storage area. In addition, a very substantial investment in thermoforming dies is required to provide the wide range of cap sizes needed, which typically will vary in quarter-inch increments. Also, substantial material is wasted in thermoforming caps because substantial space must be allowed between dies over which a sheet is formed to allow for the thinning of the sheet that occurs. Thus, for many applications a lower cost and more flexible way of providing a satisfactory cap is required.

SUMMARY OF THE INVENTION

The present invention overcomes the above and other drawbacks to the unitary thermoformed cap structure disclosed in the aforementioned copending application by providing an improved cap and method for protecting the ends of posts and pilings; more specifically, by facilitating fabrication of a suitable cap on site to a specific size and shape required, without the need for expensive forming dies or bulky inventories. The advantages of this improved post assembly and method are achieved by constructing the cap for the post or piling from an end plate correlated in size and shape to that of the pole end, and forming a skirt from a separate flexible strip that has a longitudinal groove along one side. The groove is of a width sufficient to receive the periphery of the plate and the length of the strip is equal to the circumference of the end plate. The strip is wrapped about the end plate. Opposite ends abut one another and are suitably sealed and adhered, as by tape or the like, to temporarily hold the skirt in place about the end plate and to close the juncture formed by the abutting ends of the strip. Foamable adhesive material is then placed within the cap, as described more completely in the aforesaid copending application, prior to application of the cap to the end of the pole. The cap is constructed of larger size than the end of the pole to which it is to be applied to provide space for adhesive foam.

In a preferred construction, the strip that forms the skirt is extruded and has a flange along the edge that forms the bottom of the skirt. A major portion of the skirt is of larger diameter than the pole and thus is spaced from the pole periphery when in place. The flange slopes from this major portion inwardly toward the pole to present an inclined surface or beveled end rather than an abrupt change in diameter at the bottom edge of the skirt. The flange tends to prevent leakage of the foamable adhesive from beneath the cap as the adhesive expands during application of the cap to the pole, and reduces the tendency of ropes and the like to be caught beneath the cap when it is used on a pole or piling of a dock or the like.

End plates for the cap can be cut to size from sheet stock with an inexpensive circle cutter at the point of installation. Skirts can be cut to the required length from a continuous strip. Odd shaped caps (for example, out of round shape) can be cut with hand shears to the exact shape required, providing complete flexibility to accommodate posts or pilings, which when made of natural materials, such as logs or the like, are not of uniform size or shape. Plates and skirts can also be precut and stored for the most common sizes. When stored unassembled, they require little space and can be quickly and conveniently assembled for installation on site. Thus, inventory and tooling costs can be very substantially reduced without sacrificing rapid assembly and convenient installation.

The above and other features and advantages of the invention will become better understood from the detailed description that follows, when considered in connection with the accompanying drawings.

DETAILED DESCRIPTION OF PREFERRED EMBODIMENTS

Figure 1:
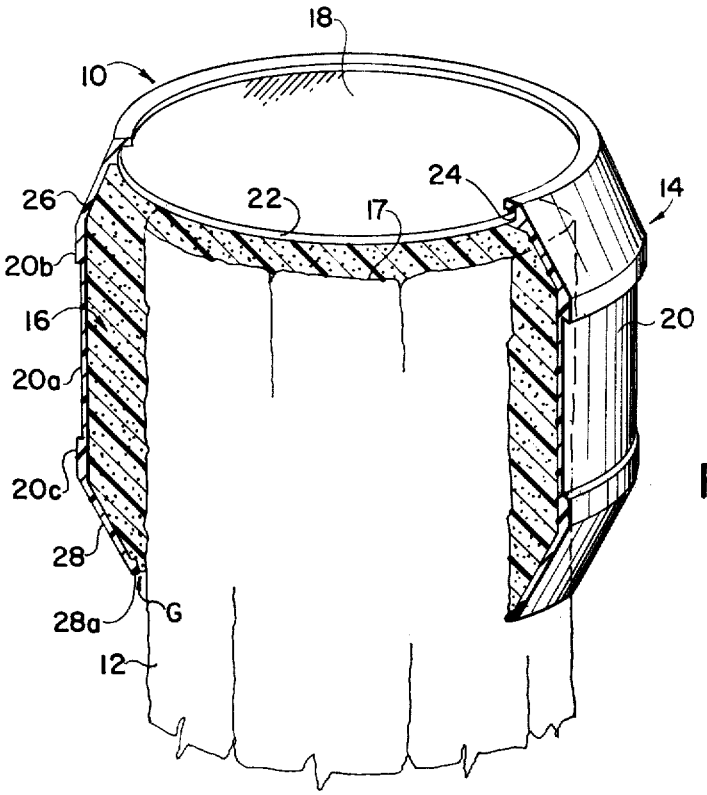
FIG. 1 is a perspective view, with parts broken away and in section, of a post and cap constructed in accordance with the present invention.

A preferred embodiment of the post assembly 10 of the present invention is shown in FIG. 1 of the drawings. The assembly comprises a post 12, a cap 14, and a foamed adhesive cushion 16 between the two.

In the embodiment shown, the post 12 is a wooden post or piling as used for a dock, fence, or the like. It is generally cylindrical and the wood grain runs longitudinally. The end grain of the post is exposed at the end 17. The post is solid and chemically treated, as with creosote or the like, to inhibit deterioration. It should be understood that posts of other material and construction can be used to form the post assembly 10.

The cap 14 is larger than the end of the post 12 and provides a space between the cap and post for the foam cushion 16. The cap is of a tough material, resistant to impact, abrasion, and weathering. It is also of a material capable of being adhered by the foamed adhesive material 16. Advantageously, the cap 14 is of a synthetic resin. The cap has a top portion or end plate 18 that is generally circular, and a generally cylindrical skirt portion 20. Suitable materials of which the cap 14 is made are acrylonitrile-butadiene-styrene (ABS), such as Cycolac manufactured by Borg-Warner Corporation, polyvinyl chloride, synthetic rubber, or metal.

As shown in the drawings, the end plate 18 is of a size and shape approximating the post end, being slightly larger in diameter, and having a peripheral edge 22 received in a groove 24 of the skirt 20. Depending upon the shape of the skirt, the end plate may be larger or smaller than the end 17 of the post, the important factor being that the cap in its entirety be sufficiently larger than the end of the post to accommodate a cushioning layer of foam 16 about the end of the post. The end plate is conveniently cut from flat stock, such as a plastic sheet, with a conventional circle cutter adjustable for any size. Where non-circular shapes are desired, such as ovals or other forms, a template and knife or hand shears or jig saw can be used. For higher production, as for stock or inventory, a die cutter, such as a rule die or the like can be used to produce end plates in incremental sizes, such as diameters that vary in quarter-inch increments. By completely fabricating the cap on site, the post can be measured and an end plate cut of optimum size.

The skirt 20 is initially in strip form, extruded with longitudinal flanges 26, 28 on opposite margins. The flanges are inclined away from a central portion 30 that is flat when the skirt is in strip form. When wrapped about the plate 18, the flanges produce conical or beveled surfaces that are inclined away from the central portion 30 and toward the post, and the central portion produces a cylindrical skirt portion of larger circumference than the periphery of the post. In the preferred embodiment, the central portion has an external recessed surface **20*a* between spaced parallel ridges 20*b*, 20*c*** to accommodate raised indicia, such as letters or insignia.

The flange 26 terminates at its inner periphery in the groove 24, which is of sufficient depth to allow for slight discrepancies between the plate diameter and the skirt length. The height of the groove in combination with the resiliency of the skirt material provide frictional engagement with the plate for a tight seal, but though desirable, this is not essential, since the path of escape of adhesive through the groove during foaming is circuitous enough to essentially obstruct flow even with a clearance fit. Where the flanges 26, 28 are equal in size and angle, as in the embodiment disclosed, the plate 18 is cut to a diameter larger than the post end by twice the depth of the groove 24, plus any additional amount desired for clearance between the flange 28 and the post, to position the flange 28 in close surrounding relationship with the side of the post.

The flange 28 terminates in a flat cylindrical surface **28*a* adapted to closely surround the post. In practice, for ease of application and to allow for irregularities in the post, which are inherent in natural products, the plate 18 is cut large enough to space the surface 28***a* slightly from the post, as shown at G. An O-ring (not shown), small in cross section, initially placed about the post to locate the cap with the plate 18 above the end of the post while the adhesive foams, expands and hardens (as described in the aforementioned application), temporarily seals the gap G between the cap and post to retard escape of expanding foam. The resulting bevel created by the flange 28 between the post surface and the larger diameter cylindrical parts 20*a–c* inhibits ropes or the like from catching beneath the cap and presents an attractive, finished appearance.

Figure 2:
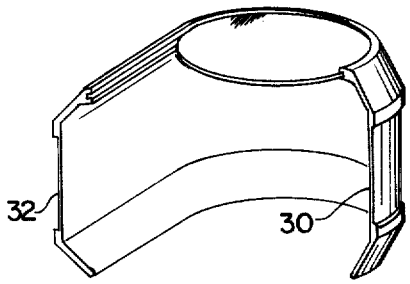
FIG. 2 is a perspective view of a cap embodying the present invention, in partially assembled form.
Figure 3:
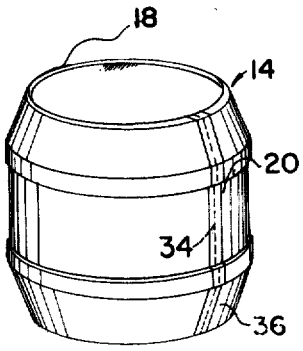
FIG. 3 is a perspective view of the cap of FIG. 2 in completed form.

The manner in which the skirt 20 is applied to the plate 18 is illustrated in FIG. 2. As shown, the skirt in strip form first receives the plate in a portion of the groove 24 and the strip is then formed into a cylinder around the plate, with the groove progressively receiving the remainder of the plate periphery. Because the strip is originally cut so the length of the inner wall of the groove essentially equals the perimeter of the plate, the two opposite ends 30, 32 of the strip closely abut and form a juncture 34. This juncture is then sealed, as by applying an adhesive strip 36, such as tape or the like, to the outside of the skirt. This holds the skirt about the plate and keeps the foamable adhesive from escaping between the ends 30, 32 while the cap is applied to a post. Once the adhesive sets, the tape can be removed.

The foamed adhesive cushion 16 is a semi-rigid foam that is expanded in place and is maintained under some pressure as it expands to assure that it fills all voids between the end of the post 12 and the cap 14, seals the end grain of the post, and fills the entire space between the cap and post end. The adhesive cushion is predominantly a closed-cell foam and serves as a support, underlying the cap and cushioning the cap from and absorbing the force of impacts. A suitable foam material is polyurethane of 4.5 pounds per cubic foot density. The preferred range of densities of the foam is 3.0 to 7.5 pounds per cubic foot to provide adequate ability at the lower density to withstand impact, and to still provide cushioning and impact absorption at the higher density. The polyurethane strongly adheres to both the cap and the post after it foams and effectively secures the cap to the post end in a sealed relationship.

Installation of the cap 16 upon the end of a post is conveniently accomplished by introducing mixed chemicals that form the foam into the cap, tilting or rocking the cap to spread the chemical about the inside surface of the cap, and then placing the cap on the end of a post 12 while the chemicals foam. The cap must be retained over the end of the post against the expansion force of the foam to assure that the foam will spread throughout the space between the post and cap and will enter all crevices of the post so the end grain is completely sealed and the cap completely supported and cushioned. The cap must be spaced from the end 17 of the post at all locations to assure complete cushioning.

While the cap described has been shown on an upper end of a post or piling, it will be apparent that a cap of the same or similar construction can be used on the lower ends of posts or pilings that may be embedded into supporting terrain, such as sand, earth or the like.

While a preferred embodiment of the invention has been disclosed in detail, it will be apparent that various modifications and alterations may be made therein without departing from the spirit and scope of the invention set forth in the appended claims.

What is claimed is:

1. In a post assembly including a post with a solid or closed end, a cover extending across said end and about side portions of the post adjacent said end, said cover being spaced from said end, and a foamed, semi-rigid, energy-absorptive, adhesive completely filling the space between said cover and said end and adhering the cover to the post, the improvement wherein said cover is comprised of a plate adjacent said end and a tubular skirt that extends about side portions of the post, the skirt having an inwardly opening circumferential groove in which the periphery of the plate is located.

2. In a post assembly as set forth in claim 1, the improvement wherein said skirt is a flexible strip having opposite ends abutting each other.

3. In a post assembly as set forth in claim 2, the improvement wherein a strip of tape is adhesively secured along the opposite abutting ends of the skirt to seal the strip along the opposite ends.

4. In a post assembly as set forth in claim 1, the improvement wherein the skirt has an inwardly extending flange about the other end from that having the groove, said flange at its inner edge closely encircling the post.

5. In a post assembly as set forth in claim 1, the improvement wherein the skirt is an extrusion with a central flat portion substantially spaced from the periphery of the post and with flanges along opposite edge portions, each flange inclined toward the post and away from the flat portion and terminating in edges the circumferential lengths of which approximate that of the post at locations adjacent to each, the edge of one flange carrying said groove.

6. A post assembly comprising a post with a solid or closed end; a two part cover extending across said end and about side portions of the post adjacent said end, said cover being spaced from said end and from side portions and comprised of a plate in the approximate shape and correlated to the size of said post end and a tubular skirt that extends about the side portions of the post, the skirt being formed from a strip that encircles the plate and that has an inwardly opening circumferential groove along one edge, in which the periphery of the plate is located, and two ends in abutting relationship; and a foamed, semi-rigid, predominantly closed-cell, energy-absorptive, adhesive completely filling the space between said cover and said end and adhering the cover to the post.

7. A post assembly as set forth in claim 6, wherein the skirt has an inwardly extending flange along the other end from that having the groove, said flange at its inner edge adapted to closely encircle the post.

8. A method of covering and sealing the end of a pole, comprising the steps of forming a cap that will fit over the end of the pole by cutting an end plate and wrapping a grooved strip about the end plate to form a skirt, the groove receiving the periphery of the end plate and the ends of the strip abutting each other, the end plate and strip each being made to a size and shape that will loosely fit over the end of the pole, sealing the strip along the abutting ends, foaming a synthetic adhesive resin between the cap and pole end, and allowing the resin to harden.

9. In a method of protecting a pole end, including the steps of providing a cap larger than the end to be protected, placing the cap over the pole end with inside surface portions of the cap spaced from the pole end, foaming and expanding a synthetic resin within the space between the cap and pole end, restraining the cap against movement from the pole end as the resin foams and expands, and allowing the resin to harden with the cap spaced from the pole end, the improvement comprising the steps of forming the cap by providing an end plate correlated in size and shape with the pole end, providing a flexible strip one edge of which has a longitudinal groove for receiving the periphery of the plate, wrapping the strip about the end plate to locate the plate in the groove, abutting opposite ends of the strip and sealing the juncture of the abutting ends.

* * * * *